United States Patent [19]

Lissner

[11] Patent Number: 4,625,257

[45] Date of Patent: Nov. 25, 1986

[54] ANTI-STATIC CHAIR

[76] Inventor: David Lissner, 5250 Briggs Ave., La Crescenta, Calif. 91214

[21] Appl. No.: 704,162

[22] Filed: Feb. 22, 1985

Related U.S. Application Data

[63] Continuation-in-part of Ser. No. 672,617, Nov. 19, 1984, abandoned.

[51] Int. Cl.[4] ..... H05F 3/02

[52] U.S. Cl. ..... 361/212; 361/220

[58] Field of Search ..... 361/212, 216, 219, 220, 361/223

[56] References Cited

U.S. PATENT DOCUMENTS

| | | | |
|---|---|---|---|
| 2,858,482 | 10/1958 | Nutter | 361/216 |
| 4,208,696 | 6/1980 | Lindsay et al. | 361/212 |
| 4,307,144 | 12/1981 | Sanders et al. | 361/212 |
| 4,513,347 | 4/1985 | Wilcox et al. | 361/220 |

OTHER PUBLICATIONS

"Condulon Low & High Density Conductive Foams" brochure, Bemis Company, Minneapolis, MN 5-1-82.

Anti-Static and Conductive Foam brochure, Controlled Static, Santa Fe Springs, CA.

*Primary Examiner*—L. T. Hix
*Assistant Examiner*—David M. Gray
*Attorney, Agent, or Firm*—Sheldon & Mak

[57] ABSTRACT

A chair for discharging static electricity carried by an occupant has a non-conductive seat covering and an electrode under the covering for permitting the occupant to safely touch a source of current having a moderate voltage of less than about 200 volts, without being shocked thereby. When the charge exceeds a predetermined level, current flows through the covering between the occupant and the conductor, discharging the occupant. The electrode can be a flexible wire or a resilient foam member. A current limiting resistor protects the occupant from high discharge currents. The chair can have a wheeled base of electrically conductive construction for grounding the chair. In one version of the chair, a discrete breakdown device prevents discharge from moderate voltages and the covering can be made conductive.

20 Claims, 5 Drawing Figures

ANTI-STATIC CHAIR

This application is a continuation-in-part of copending application Ser. No. 672,617, filed Nov. 19, 1984, now abandoned, which is incorporated herein by this reference.

BACKGROUND

This invention relates to laboratory and production work stations such as for assembly, testing and operation of sensitive electronic devices, and more particularly to a chair for safely discharging static electricity.

It is well known that certain electronic devices can easily be damaged by discharges of static electricity. To prevent such damage and to avoid worker discomfort associated therewith, electrically conductive grounded chairs have been used to provide a discharge path for static electricity that does not damage the electronic devices.

A further development of the prior art is the use of electrically conductive cushions or cushion coverings to provide a conductive chair that is comfortable to sit in.

A disadvantage of the electrically conductive chairs of the prior art is that an occupant seated in such a chair can be electrically shocked, and possibly injured by contact with points of relatively low voltage commonly present in the working environment. Where no conductive chair or other path to ground is used, a worker can safely touch conductors having a single elevated potential in access of 100 volts without shock or injury.

Another disadvantage of chairs having electrically conductive cushions or cushion coverings in the prior art is that the electrically conductive materials are expensive to produce.

Accordingly, there is a need for a chair that safely discharges static electricity, without subjecting an occupant to shock if he touches a conductor having moderately elevated potential, and is economical to produce.

SUMMARY

The present invention is directed to an anti-static chair that meets these needs. The chair includes a seat having a conductive element, a grounded member, means for conducting an electrical charge from an occupant of the chair to the grounded member, and means for preventing the discharge until the charge voltage exceeds a predetermined level.

In one version of the chair, a conductive wire, under a non-conducting seatcover of the chair, provides a breakdown current path to ground when the electrical charge of the seated occupant reaches a predetermined level at which current flows from the occupant through the covering to the wire.

In another version, a conductive foam member is used as an electrode in place of the conductive wire. The conductive foam member can provide padding for the seat as well as a breakdown current path to ground through the covering.

Preferably the chair includes means for limiting current levels passing from the occupant to the grounded member for preventing discomfort when discharging high levels of static charge. The current limiter can be a series resistor ohm that can have a resistance on the order of one megohm connected between the wire and the grounded member.

In another version of the chair, a supporting member for the occupant has a conductive member proximate to the occupant for discharging to ground a static charge on the occupant, and means for preventing the discharge until the charge reaches a predetermined level. The conductive member can be a conductive fabric and the means for preventing can be a Zener diode.

In a further version, the chair has a supporting structure that permits the seat to be swiveled in a horizontal plane and adjusted vertically. The grounded member can be a lower portion of the supporting structure. The conductive wire can be connected to an upper portion of the supporting structure for ease of manufacture. A flexible conductive member, connected to the upper supporting structure, hangs down and contacts a platform on the lower supporting structure for continuously maintaining electrical contact between the upper and lower supporting structures during swiveling and adjustment of the chair.

Preferably the upper portion of the supporting structure is electrically isolated from the grounded member, so that the current limiting resistor can be connected between the upper and lower portions of the supporting structure.

Thus a chair is provided that safely discharges static electricity and is economical to produce, yet does not shock an occupant if he touches a conductor having moderately elevated potential.

DRAWINGS

These and other features, aspects, and advantages of the present invention will become better understood with reference to the following description, appended claims, and accompanying drawings, where:

DESCRIPTION

The present invention is directed to a chair capable of discharging a static electrical charge associated with an occupant of the chair without shocking the occupant if he happens to touch a conductive surface connected to a source of moderate electrical potential in the range of 100 to 200 volts.

Mechanical Features

Figure 1:
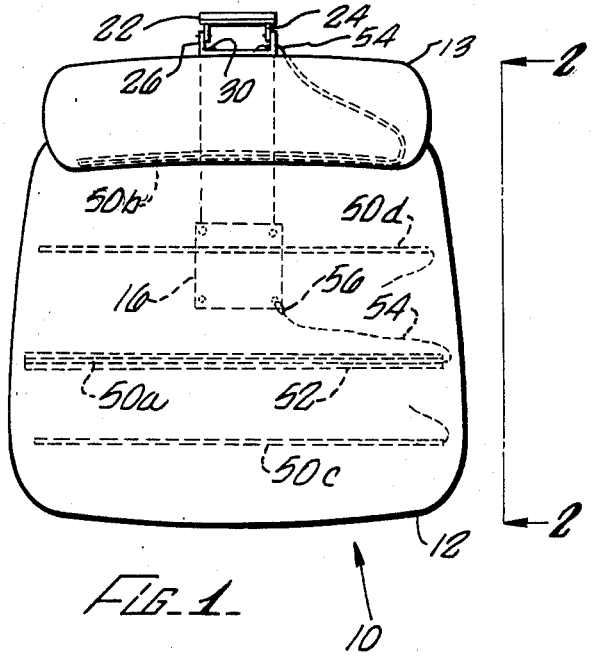
FIG. 1 is a plan view of a chair according to the present invention.
Figure 2:
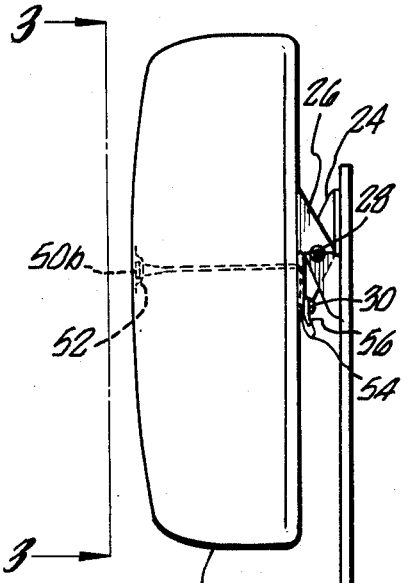
FIG. 2 is a side elevational fragmentary sectional view of the chair of FIG. 1 taken along line 2—2 in FIG. 1.
Figure 2:
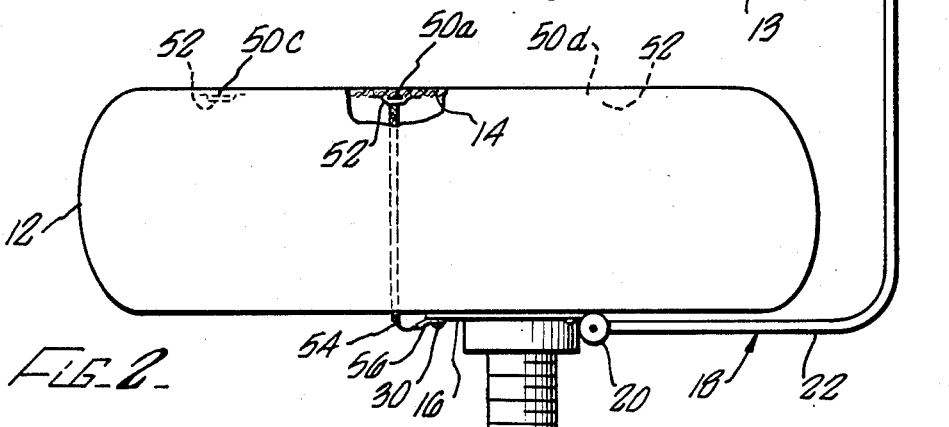
Figure 3:
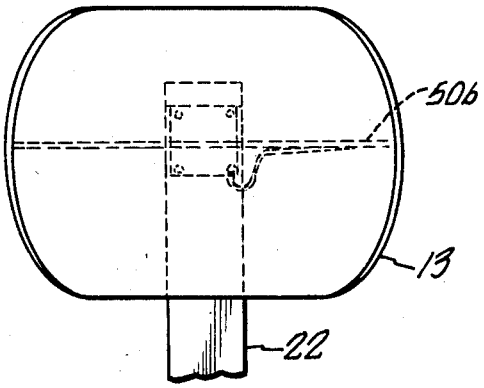
FIG. 3 is a fragmentary front elevational view of the chair of FIG. 1 taken along line 3—3 in FIG. 2.

With reference to FIGS. 1-3, a chair 10 includes a seat 12 and a back 13, the seat 12 and back 13 being covered by a cushion fabric 14. A base assembly 15 provides support for the chair 10.

Preferably the seat 12 and the back 13 are provided with resilient filler materials and/or structure (not shown) for comfortably supporting an occupant of the chair 10.

A seat platform 16, located above the base assembly 15, supports the seat 12 and a back support assembly 18. The back support assembly 18 is fastened to the seat platform 16 by a support attachment 20. The support attachment 20 can incorporate a biasing means (not shown) for resilient mounting of the back support assembly 18 to the seat platform 16. The back support assembly 18 includes a support member 22 extending above the seat 12. A support bracket 24 is fixed to the support member 22 for support of the back 13. A hinge bracket 26, pivotally connected to the support bracket 24 by a hinge pin 28, and is fastened to the back 13 by a plurality of cushion screws 30. A biasing member (not shown) can be connected between the support bracket 24 and the hinge bracket 26 for urging the back 13 into a generally vertical position.

Support for the seat platform 16 is provided by a seat post 32 extending downwardly therefrom, the seat post 32 being threaded and engaging a swivel nut 34 on the base assembly 15. The swivel nut 34 is supported by a swivel bearing 36, the swivel nut 34 being held in place by a swivel screw 37. The swivel bearing 36 is supported and located by a column tube 38, the column tube 38 being supported by a plurality of frame members 40 radiating therefrom, each frame member 40 being equipped with a wheel assembly 42 for facilitating movement of the chair 10. A column sleeve 44 can be provided as a decorative covering for the column tube 38.

Electrical Features

In a first version of the present invention, the chair 10 is equipped with at least one electrode 50, one such electrode being designated **50*a* in FIG. 2. Each electrode 50 can be a flexible conductor such as a braided wire. The electrode 50*a* is located within the seat 12 in contact with the cushion fabric 14 and positioned to be compressed against the cushion fabric 14 when an occupant is in the chair. The electrode 50*a* can be held in position by an electrode pocket 52, the electrode pocket 52 being sewn to the cushion fabric 14. The electrode 50*a*, in combination with the cushion fabric 14**, forms a breakdown device for preventing electrical shock should the occupant touch a conductor connected to a source of moderate voltage, such as 100–200 volts.

One end of the electrode **50*a*, extending axially beyond the electrode pocket 52, forms an electrode lead 54, passing through the seat 12 to a point proximate to the seat platform 16. The electrode lead 54 can be terminated by a lead terminal 56 and electrically connected to the seat platform 16 by one of the cushion screws 30**.

At least one of the electrodes 50 can be located within the back 13 of the chair 10, such a location being designated **50*b* in FIG. 2. The electrode 50*b* is located within the back 13 against the cushion fabric 14, one end thereof forming an electrode lead 54 extending externally to the back 13 proximately to the hinge bracket 26. The electrode lead 54 is electrically connected to the hinge bracket 26 by a lead terminal 56 and clamped thereto by one of the cushion screws 30. Electrically conductive materials are used in the back support assembly 18 to provide a conductive path from the lead terminal 56, through the support member 22 to the seat platform 16**.

As an alternative to the electrode **50*a* in the seat 12, a pair of electrodes 50*c* and 50*d*, each electrically connected to the seat platform 16 as described above, can be longitudinally separated for assuring that at least one of the electrodes 50 will be compressed under the cushion fabric 14 when an occupant is in the chair 10**.

The swivel bearing 36 can be made of a non-conductive material such as an acetal resin for electrical isolation of the seat post 32 and the swivel nut 34 from the column tube 38 and the column sleeve 44.

Preferably the chair 12 is provided with means for limiting electrical current levels associated with the discharge of static electricity, so that the discharge is accomplished in a reasonable time and static charge accumulation by occupant does not damage electronic devices contacted by the occupant, yet not severely shocking an occupant of the chair. A discharge resistor 60 can be connected between the seat post 32 and the base assembly 15 for this purpose. The discharge resistor 60 can have a resistance on the order of one megohm.

The resistance of the discharge resistor 60 can be selected dependent on operating conditions such as the tolerance of the occupant and/or the electronic devices to discharge currents, and the strength and proximity of static charge sources. The selected resistance can range from a nominal value, such as 10 ohms, up to about five megohms.

Preferably the discharge resistor 60 is easily replaceable so that a desired resistance value appropriate for a given operating environment can be conveniently provided. The discharge resistor, enclosed in a non-conductive resistor sleeve 62, can be pressed into a cavity 63 provided in the seat post 32. A first resistor lead 64 can be folded over the resistor sleeve 62 for electrical contact with the seat post 32. A second resistor lead 66, extending below the discharge resistor 60, can be connected by a flexible conductor 68 to the base assembly 15. Thus the resistor 68 is securely mechanically and electrically connected to the seat post 32, yet it can be easily removed and replaced with another having a different resistance. Thus the discharge characteristic of the chair can easily be modified to suit a particular operating environment.

The flexible conductor 68 can be a beaded metallic chain for conveniently providing continuous electrical contact between the discharge resistor 60 and the base assembly 15 regardless of the position and orientation of the seat post 32 with respect to base assembly 15. The beaded metallic chain provides a further advantage in that endless swivelling of the chair does not interrupt the electrical contact.

In order to insure the continuous electrical contact of the beaded chain of the flexible conductor 68, the chain can be treated to remove non-conducting matter from the beads and links thereof. The chain can be further treated with a deposit of conducting material such as powdered graphite. The powdered graphite can be suspended in a volatile solvent in which the chain is washed, then deposited on the chair as the solvent evaporates. Thus the removal of non-conducting matter and the deposit of conducting material is easily accomplished in a single operation.

The second resistor lead 66 can be conveniently looped through a conventional coupling link 70 such as is commonly supplied with beaded chain. A plug cap 72 can be pressed into the column tube 38 for providing a conductive support for the flexible conductor 68. Preferably the wheel assemblies 42 are made using electrically conductive materials for completing an electrical connection from the plug cap 72, through the column tube 38 and the frame members 40 to the floor 11.

Alternatively, the base assembly 15 can be electrically connected to ground by a suitable ground lead (not shown).

Operation

In operation, the base assembly 15 is maintained at ground potential by contact of the wheel assemblies 42 with a conductive surface of the floor 11. Alternatively, the base assembly 15 is connected by a suitable wire to a source of ground potential.

When no current is flowing through any of the electrodes 50, the electrodes 50 are held at ground potential by use of a conductive path through the discharge resistor 60. When a person carrying a high voltage static charge sits in the chair 10, the cushion fabric 14 is pressed tightly between the occupant and at least one electrode 50, producing a narrow gap between the body of the person and the electrode 50. A voltage potential gradient sufficient to permit current flow is created within the gap. The current, limited by the discharge resistor 60, continues to flow until the static charge has been reduced to a level below which current ceases to flow.

When an occupant of the chair 10 touches a conductor at a moderate potential (up to about 200 volts, depending on properties of the cushion fabric 14) the potential gradient in the gap is lower than that required for meaningful current flow. Thus the electrode 50, in combination with the cushion fabric 14, functions as a breakdown device so that the occupant is not shocked when he touches the conducting surface.

Figure 4:
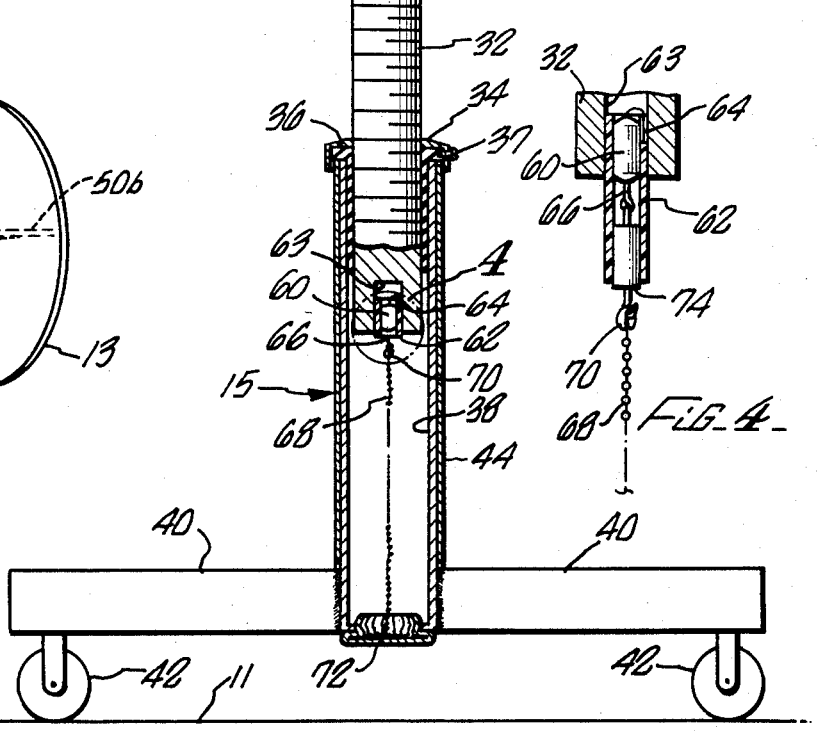
FIG. 4 is a detail of an alternative configuration of the chair of FIG. 1 within region 4 in FIG. 3.

In another version of the chair of the present invention, the cushion fabric 14 can be made electrically conductive, the electrode 50 and the electrode pocket 52 no longer being required. With reference to FIG. 4, a discrete breakdown device 74, such as a zener diode, can be electrically connected in series between the seat post 32 and the base assembly 15. The breakdown device 74 can be a bipolar semiconductor device comprising a pair of zener elements connected back-to-back for symmetrical positive and negative discharge characteristics. The resistor sleeve 62 can be elongated below the discharge resistor 60 for providing lateral support for the breakdown device 74, the breakdown device 74 being electrically and mechanically connected between the discharge resistor 60 and the coupling link 70. The breakdown characteristics of the breakdown device 74 can be selected to set a predetermined static discharge threshold. For example, a zener diode having a voltage raging of 200 volts would protect an occupant of the chair from being shocked should he touch a source of less than 200 volts.

Figure 5:
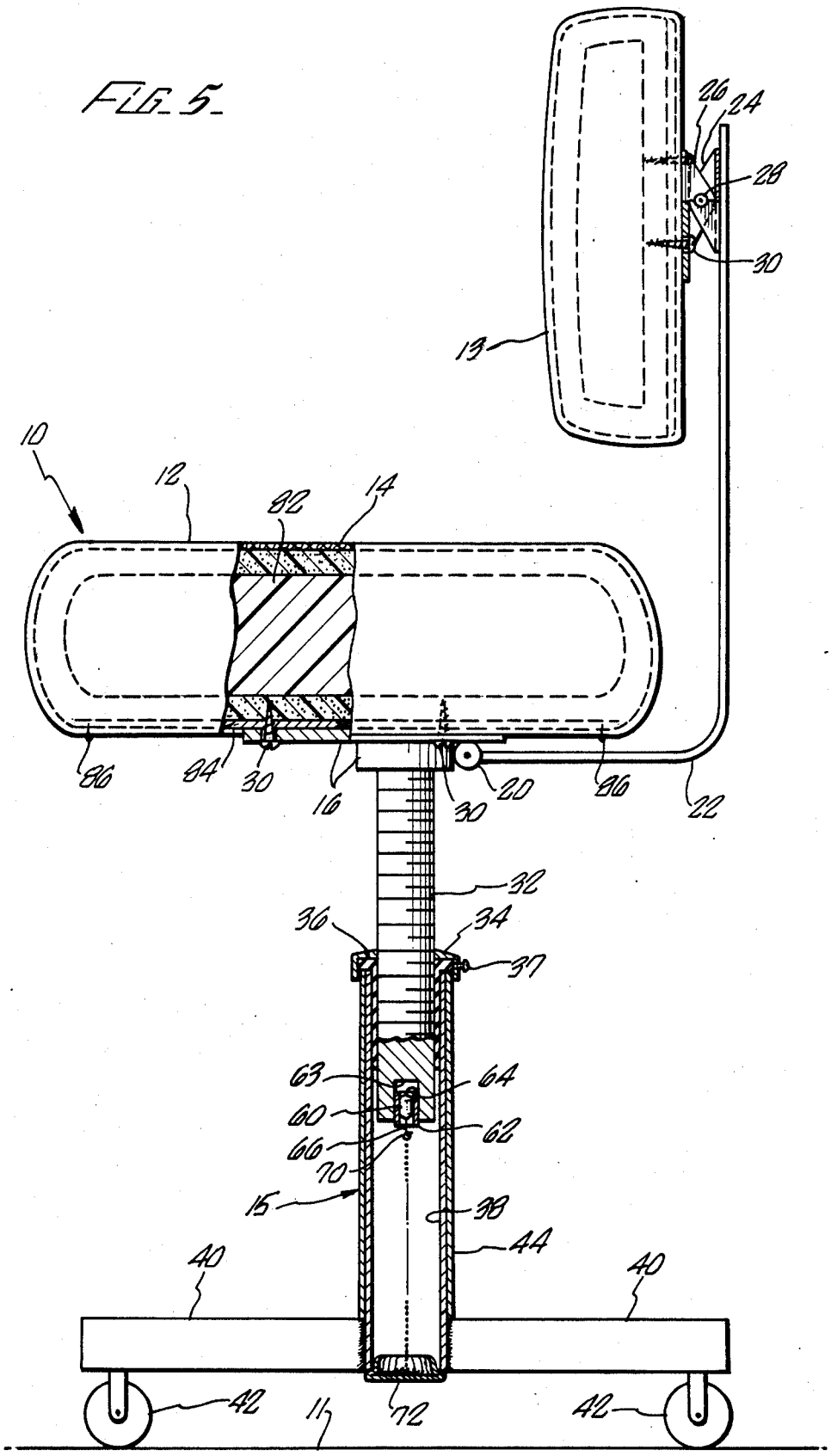
FIG. 5 is a side elevational fragmentary sectional view of an alternative configuration of the chair of FIG. 1 taken along line 2—2 in FIG. 1.

With reference to FIG. 5, a further version of the chair of the present invention includes conductive padding in the seat 12 and/or the back 13. For example, the conductive padding can be a flexible or resilient conductive foam member 80, located within the seat 12 in contact with the cushion fabric 14. The conductive foam member 80 can facilitate construction of the chair 10 by functioning as an electrode in place of the electrode 50, the electrode pocket 52, electrode lead 54, and lead terminal 56.

The conductive foam member 80 can comprise a conductive material such as carbon and a generally non-conducting foam material such as polypropylene, polyethelyne, or polyurethane. The conductive material can be dispersed in the foam material or deposited thereon in a polymeric coating.

The conductive material is normally dispersed in closed-cell foams such as polypropylene and polyethelyne, but deposited onto open-celled polyurethane, because polyurethane is subject to non-uniform curing when mixed with carbon.

Commercially manufactured polyurethane foam having desirable mechanical and electrical properties is known as "low density conductive foam," and has a density of from about one to three pounds per cubic foot. One formulation, having a surface resistivity of $10^4$ ohms/square and a volume resistivity of $10^5$ ohms/cm, sold under the trademark Condulon, is available from Bemis Company, Minneapolis, Minn. Another formulation, having a surface resistivity of $3\times10^4$ ohms/square and a volume resistivity of $3\times10^3$ ohms/cm, is available from Charles Water Products, Inc., West Newton, Mass. A further formulation, available from Great Western Foam Co., Los Angeles, Calif., has a surface resistivity of $10^3$ ohms/square and a volume resistivity of $10^4$ ohms/cm.

Flexible conductive foam material is readily available in thicknesses of from about ⅛ inch to about one inch. Consequently, the conductive foam member 80 can be configured to surround a nonconducting conventional foam member 82, inexpensively providing sufficient foam for the seat 12. It has been found that the best combination of mechanical and electrical properties results when the conductive foam member 80 has a thickness of from one-fourth to one-half inch.

The conductive foam member 80 (and the conventional foam member 82) can be supported by the seat platform 16 on a cushion panel 84. Electrical contact between the seat platform 16 and the conductive foam member 80 can be provided by selecting the cushion screws 30 of sufficient length to protrude into the conductive foam through the cushion panel 84.

The cushion fabric 14 can extend under the cushion panel 84, fastened thereto by a plurality of staples 86 for confining the conductive foam member 80 within the seat 12 (and the back 13).

The chair 10, having a conductive foam member 80 one-fourth inch thick made from the Great Western foam, has a conductive path measuring from approximately 500k ohms to approximately 1 megohm between the top of the seat (under the cushion fabric 14) and the seat platform 16. When the Charles Water Products' foam is substituted, the measured resistance decreases to from approximately 40k ohms to approximately 90k ohms. This resistance can be conveniently measured while piercing with a suitable probe the conductive foam member 80, proximate to the center of the seat 12.

In most applications, a current limiting resistance of about 1 megohm is desired between the seat and ground potential, as described above. Thus, when using low resistivity foam such as the Charles Water Products' foam, the function of the discharge resistor 60 is relatively unchanged by substitution of the conductive foam member 80 for the electrode 50.

Alternatively, sufficient electrical resistance can be provided in the conductive foam member 80, using the Great Western foam, for example, to produce a desired degree of current limiting, thus avoiding the need for the discharge resistor 60. The resistance can be increased by using foam of lower coductivity and/or decreased thickness. Moreover, a labyrinth pattern can be incorporated into the conductive foam member 80 between the cushion screws 30 and the sides of the seat 12 for increased electrical resistance.

It should be understood that the construction and electrical properties of the seat 12 and the back 13 may be made similar or intentionally divergent within the scope of the present invention.

The chair of the present invention provides protection for sensitive electronic devices from damaging static electric discharge by draining static charges from an occupant. However, the occupant can touch sources of current at moderate voltages without fear of being shocked.

Although the present invention has been described in considerable detail with reference to certain preferred versions thereof, other versions are possible. For example, the base assembly 15 can be integrated with structure for a work bench, with or without the wheel assemblies 42. Also, a parallel combination of the breakdown device 74 and the discharge resistor 60 with another resister can be used to alter the discharge characteristics of the chair. Therefore, the spirit and scope of the appended claims should not necessarily be limited to the description of the preferred versions thereof.

What is claimed is:

1. A chair for discharging a static electrical charge carried by an occupant of the chair, the chair comprising:

(a) a seat comprising an electrode for discharging a static electrical charge carried by the occupant;

(b) means for connecting the electrode to a source of ground potential; and (c) means for preventing the discharge until the charge exceeds a predetermined level, the means for preventing comprising a breakdown device connected between electrode and the means for grounding.

2. The chair of claim 1 wherein the electrode is a conductive foam member.

3. The chair of claim 1 including means for limiting electrical current flow between the electrode and the means for grounding.

4. The chair of claim 3 wherein the limiting means comprises a series resistor connected between the electrode and the source of ground potential.

5. A chair for discharging a static electrical charge carried by an occupant of the chair, the chair comprising:

(a) a padded supporting member for the occupant, the supporting member having a conductive member located proximate to the occupant, the conductive member comprising a conductive fabric;

(b) means for grounding the conductive member; and (c) means for preventing the grounding means until the charge reaches a predetermined voltage level.

6. The chair of claim 5 including a resistor connected between the conductive member and the means for grounding for limiting current passing from the occupant to ground.

7. The chair of claim 5 wherein the means for preventing comprises a breakdown device connected between the conductive member and the grounding means.

8. A chair for discharging a static electrical charge carried by an occupant of the chair, the chair comprising:

(a) a padded supporting member for the occupant, the supporting member having a conductive element located proximate to the occupant;

(b) an electrically conductive frame member supporting the supporting member, the frame member being electrically connected to the conductive element;

(c) an electrically conductive base, the frame member being vertically adjustably mounted to the base;

(d) a flexible conductive member electrically connected to the frame member and suspended therefrom; and (e) a conductive platform on the base for supporting a free end of the conductive member in continuous electrical contact for maintaining electrical continuity between the supporting member and the base during adjustment of the supporting member.

9. The chair of claim 8 in which the conductive element comprises a conductive foam member.

10. The chair of claim 8 further comprising means for preventing the discharge until the charge reaches a predetermined level.

11. The chair of claim 10 wherein the preventing means comprises a layer of material having low electrical conductivity located between the conductive element and the occupant.

12. The chair of claim 10 in which the conductive element comprises a conductive foam member.

13. The chair of claim 10 wherein the preventing means comprises a breakdown device connected between the frame member element and the base.

14. The chair of claim 8 wherein the frame member is electrically isolated from the base, the chair including means for limiting electrical current flow between the supporting member and the conductive member.

15. The chair of claim 14 wherein the means for limiting comprises a resistor.

16. The chair of claim 15 wherein the means for preventing comprises a zener diode connected in series with the resistor.

17. The chair of claim 8 wherein the flexible conductive member comprises beaded metallic chain.

18. The chair of claim 17 wherein the beaded metallic chain includes a coating of conductive powder.

19. A chair for discharging a static electrical charge carried by an occupant of the chair, the chair comprising:

(a) a seat comprising at least one resilient conductive member, the resilient conductive member being capable of discharging a static electrical charge carried by the occupant;

(b) an electrically conductive frame member supporting the seat, the frame member being electrically connected to the resilient conductive member;

(c) an electrically conductive base, the frame member being vertically adjustably mounted to the base;

(d) a flexible conductive member electrically connected to the frame member and suspended therefrom; and (e) a conductive platform on the base for supporting a free end of the conductive member in continuous electrical contact for maintaining electrical continuity between the supporting member and the base during adjustment of the supporting member.

20. A chair for discharging a static electrical charge carried by an occupant of the chair, the chair comprising:

(a) a padded supporting member for the occupant, the supporting member comprising:

(i) a conductive element comprising a conductive member located proximate to the occupant; and (ii) a layer of material having low electrical conductivity covering the conductive element for preventing the discharge until the charge reaches a predetermined level;

(b) an electrically conductive frame member supporting the supporting member, the frame member being electrically connected to the conductive element;

(c) an electrically conductive base, the frame member being vertically adjustably mounted to the base, the base being electrically isolated from the frame member;

(d) a flexible conductive member comprising beaded metallic chain, the flexible conductive member being electrically connected to the frame member and suspended therefrom;

(e) a resistor connected between the supporting member and the conductive member for limiting electrical current flow between the supporting member and the conductive member; and (f) a conductive platform on the base for supporting a free end of the conductive member in continuous electrical contact for maintaining electrical continuity between the supporting member and the base during adjustment of the supporting member.

* * * * *